US005692258A

United States Patent [19]

Griffin

[11] Patent Number: 5,692,258

[45] Date of Patent: *Dec. 2, 1997

[54] BODY SUPPORT ARRANGEMENT

[76] Inventor: Gordon D. Griffin, P. O. Box 171, Tasmania, 7301, Australia

[ * ] Notice: The term of this patent shall not extend beyond the expiration date of Pat. No. 5,524,307.

[21] Appl. No.: 662,766

[22] Filed: Jun. 11, 1996

Related U.S. Application Data

[63] Continuation of Ser. No. 777,313, Sep. 18, 1985, Pat. No. 5,524,307.

[51] Int. Cl.[6] ..... A47C 27/10; A47C 23/06

[52] U.S. Cl. ..... 5/710

[58] Field of Search ..... 5/710, 706, 655.3, 5/236.1–242

[56] References Cited

U.S. PATENT DOCUMENTS

| | | | |
|---|---|---|---|
| 2,253,801 | 8/1941 | Neal | 5/710 |
| 4,477,935 | 10/1984 | Griffin | 5/236.1 |
| 4,525,886 | 7/1985 | Savenije | 5/236.1 |

FOREIGN PATENT DOCUMENTS

| | | | |
|---|---|---|---|
| 116237 | 7/1984 | European Pat. Off. | 5/236.1 |
| 2621803 | 6/1977 | Germany | 5/236.1 |

*Primary Examiner*—Alexander Grosz

*Attorney, Agent, or Firm*—Albert W. Davis, Jr.

[57] ABSTRACT

A body support arrangement comprising a pair of flexible elongate tubes (12) forming air springs openings located in spaced parallel relationship by stabilizer members (14) which space and impart lateral stability to the tubes (12). A body support surface is formed by a series of slats (20) extending transversely of and resting on the tubes (12). The slats (20) are fixedly attached, for example by adhesive, to a flexible sheet (22).

11 Claims, 2 Drawing Sheets

BODY SUPPORT ARRANGEMENT

This application is a continuation of application Ser. No. 06/777,313, filed Sep. 18, 1985, now U.S. Pat. No. 5,524,307, granted Jun. 11, 1996.

FIELD OF THE INVENTION

This invention relates to a support system for mattresses or cushions in beds, chairs, sofas, settees, stretchers and other body support appliances.

This invention is particularly applicable to support systems wherein a mattress or cushion rests on slate extending between supporting air springs as disclosed in my U.S. Pat. No. 4,477,935 and granted European Patent No. 038155 and European Patent No. 116,237.

OBJECTS OF THE INVENTION

The object of the present invention is to provide a more economically manufactured support system that is disclosed and claimed in my aforementioned patents and applications for patents.

FEATURES OF THE INVENTION

The present invention comprises a support system including at least a pair of flexible elongate tubes forming air springs, maintained in spaced parallel relationship by members which effect the required spacing and that impart lateral stability to said tubes and a body support surface formed by a series of members extending transversely of and resting on said tubes, said body support members being fixedly attached to flexible material. Means preferably in the form of resilient end blocks provide peripheral mattress support and fixedly attached flexible material and all components are preferably enclosed within a cover providing ready access to air filler tubes for the user.

Other objects and features of the invention will become apparent from the following detailed description and drawing disclosing what are presently contemplated as being the best modes of the invention.

THE DRAWING

Figure 1:
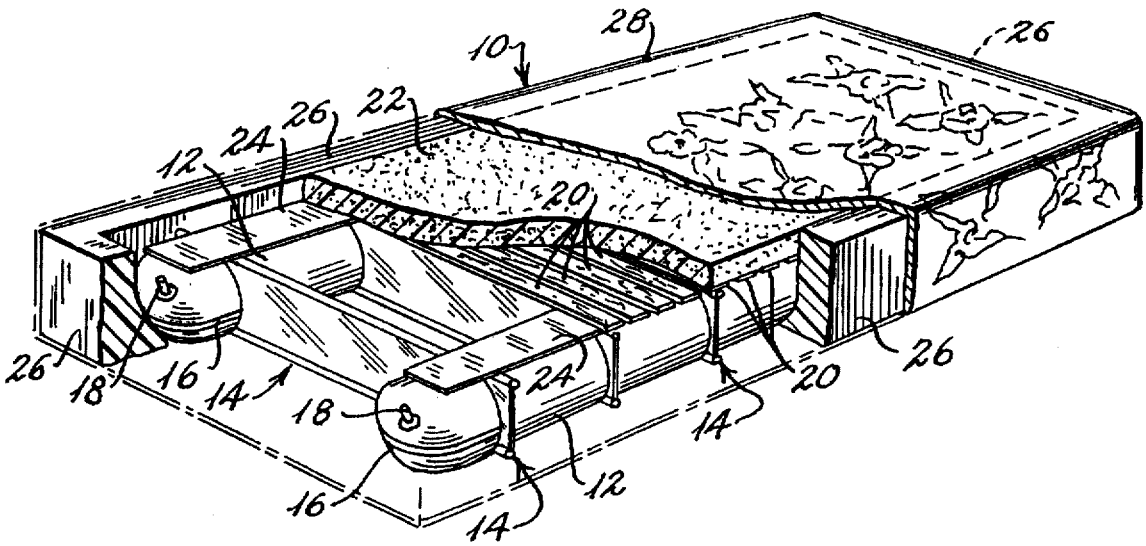
FIG. 1 is a perspective view, partly in cut-away section, of a body support system according to the present invention.

Referring now to the drawings:

As best seen in FIG. 1 of the drawings, a body support system, shown generally at 10, comprises a pair of elongate flexible tubes 12 forming air springs which are spaced apart in parallel with one another, a required predetermined distance by spacer members 14 positioned longitudinally along the tubes 12. As will be hereinafter described, in addition to spacing the tubes 12, the spacer members 14 also maintain lateral stability of the tubes while allowing vertical displacement.

Each tube 12 is formed of heat welded sheet or extruded plastics material and the end of each tube is closed by heat welds 16 with an air pressure control valve 18 in the upper portion thereof and adjacent a foot end of the tube.

A series of independent, transversely extending mattress or body support members in the form of slats 20 are fixed in closely spaced parallel relationship to the underside of a flexible foam or other sheet material 22, by, for example, an adhesive or by a hook and nap fabric fastener, such as "Velcro" (RTM) material. The end portions of the slat 20 lie on the spaced tubes 12, preferably with a vinyl wear strip 24 interposed therebetween. Conveniently the vinyl strips 24 may be attached by adhesive to the slats 20 after the latter have been fixed to the sheet 22. It will be appreciated that the showing of the slats 20 in the forward position of FIG. 1 have been omitted for the sake of clarity.

The ends and sides of the assembly are formed respectively by elongated blocks of material 26 having a higher impact load resistance, i.e. they have a higher resistance to compressibility than the plastics foam material 22. Preferably the inner wall of the blocks 26 is bevelled as shown in FIG. 1 to provide additional support for the tubes 12. The assembly is encapsulated in a cover 28 provided with an opening which extends along one side and both ends blocks 28 and 26 respectively, the opening being closed by a sliding clasp fastener (not shown). When the opening is closed the runner of the fastener is at the foot end of the cover so that sliding the runner to open the cover at the foot-end will provide easy access at the foot of the support system to the valves 18.

Figure 2:
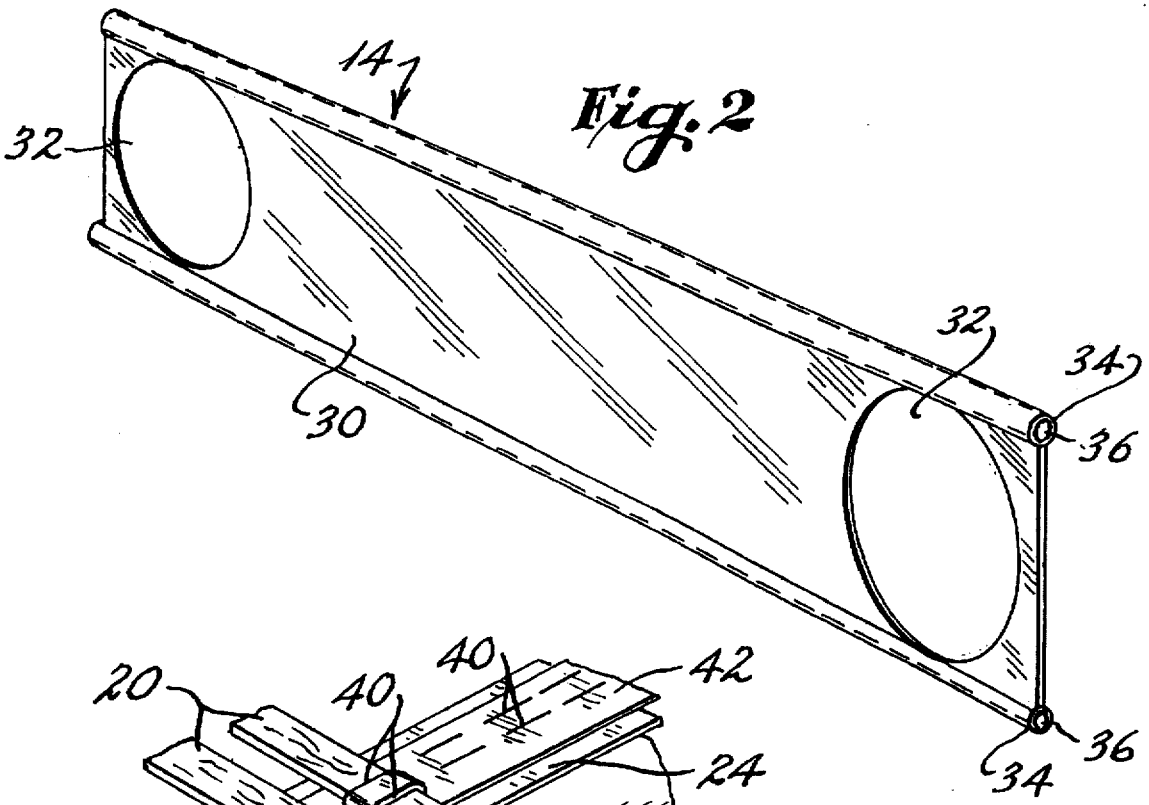
FIG. 2 is a perspective view, of a spacer and lateral stabilizer used in the system shown in FIG. 1.

As shown in FIG. 2, each spacer member 14 comprises a single membrane 30 of sheet plastics material. The membrane 30 is of a length slightly greater than the overall spacing between the tubes 12 and is provided with spaced apertures 32 whose axes correspond with the respective axes of the tubes. The diameter of the apertures 32 is slightly less than the diameter of the inflated tubes 12 to provide a gripping action when the spacer member is mounted thereon. The upper and lower edges of the membrane 30 are formed, respectively, with a sleeve 34, each accommodating a rod 36, which extends from one end of the membrane 30 to the other.

It will be readily appreciated that the spacer members 14 may take other forms. For example, a spacer member may be formed by an open-ended flattened tubular member of sheet plastics material with the rods 36 replaced by slats similar to the slats forming the support surface. With this arrangement, which positioned on the tubes 12, the spacer member cross-section is of rectangular configuration.

The use of spacer members 14 as described above enables the tubes 12 to be maintained at the required spacing even though the members 14 are deformed vertically due to a load being applied on the slats 20. Additionally, the rods 36 ensure lateral stability of the assembly. Any desired number of spacer members 14 may be used but, in general, up to five or six single membrane units are sufficient to ensure lateral stability of the tubes 12 depending on the use and manufacturing design.

Figure 3:
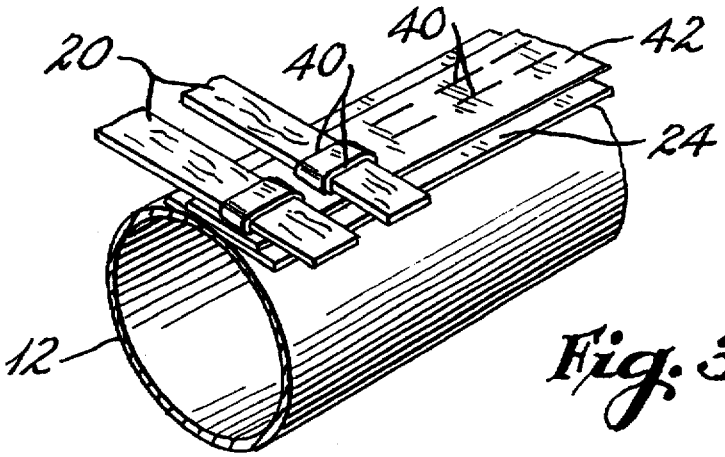
FIG. 3 is a modification of the system shown in FIG. 1.

In an alternative form of the invention as shown in FIG. 3, the slats 20, instead of being fixedly connected to the foam material 22, may have their respective end portions releasably secured in pairs of aligned slits 40 formed in flexible strips of material 42, the latter being in contact with the vinyl strip 24 or fixed to the tube 12 by adhesive. In a further construction the extremities of the slats are received in pockets formed in the facing side walls of a pair of spaced flexible strips. These latter methods might be more appropriate for Eastern style living where lightweight independent mattresses are used such as the traditional Japanese Futons. The valves, and blocks and cover used with this embodiment are not shown further in detail since they are the same as disclosed in connection with the embodiment of FIG. 1.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A method of providing a flexible body support system comprising the steps of, providing at least two flexible elongated air filled tubes, maintaining said tubes in spaced, substantially parallel relationship by spacer means and disposed longitudinally in said support system, providing a body support surface on said tubes formed by a series of spaced apart parallel body support members laying on but not attached to said tubes and extending transversely of said tubes, maintaining said body support members spacing during the use of the support of the system without the use of a systems of guides, maintaining said tubes spacing without the use of members which would make the support system rigid in the longitudinal direction of said tubes and enclosing said tubes, said body support surface and said spacer means within a cover.

2. The method of claim 1 including the step of, maintaining said tubes in spaced apart relationship by the use of stabilizer members that are rigid in the direction transverse to said tubes.

3. The method of claim 1 including the step of, providing foam elements within said cover, on the outwardly acing sides of said support system and on the top of said body support members.

4. The method of claim 1 including the step of, providing said air tubes with air valves arranged at one end of said support system, said covering being openable from the end having the air valves to provide easy access.

5. The method of claim 1 including the step of, providing said spacer means by using a foam element placed on top of said body support members and attached to said members to maintain the members spacing.

6. The method of claim 5 including the step of, affixing the body support members to the foam element by an adhesive.

7. The method of claim 5 including the step of, affixing the body support members to the foam element by a releasable fastener.

8. The method of claim 1 including the step of, providing said spacer means by using flexible strip material resting on said tubes and retaining said body support members to maintain the members spacing.

9. The method of claim 1 including the step of, providing a strip of wear resistant material between said body support members and said tubes.

10. The method of claim 1 including the step of, providing blocks of flexible material having a high impact load resistance along the outsides of said tubes.

11. The method of claim 10 including the step of, providing blocks of flexible material having a high impact load resistance across said tubes.

* * * * *